US006550627B2

(12) United States Patent
Elich et al.

(10) Patent No.: US 6,550,627 B2
(45) Date of Patent: Apr. 22, 2003

(54) CONTAINER

(75) Inventors: Terry Elich, Pittsford, NY (US); Scott Schwallie, Rochester, NY (US); Michelle Wise, Hamlin, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/835,611

(22) Filed: Apr. 16, 2001

(65) Prior Publication Data

US 2002/0148841 A1 Oct. 17, 2002

(51) Int. Cl.[7] ..... B65D 1/42; B65D 23/10

(52) U.S. Cl. ..... 215/384; 215/383; 220/672; 220/673

(58) Field of Search ..... 220/673, 670–675; 215/382, 383, 384

(56) References Cited

U.S. PATENT DOCUMENTS

| | | | | | |
|---|---|---|---|---|---|
| 3,595,430 | A | * | 7/1971 | Massae | 220/673 |
| 4,062,385 | A | | 12/1977 | Katusha et al. | 141/89 |
| 4,982,771 | A | | 1/1991 | Bertram et al. | 141/312 |
| 5,178,289 | A | * | 1/1993 | Krishnakumar et al. | 220/673 |
| 5,592,980 | A | | 1/1997 | Stern et al. | 141/364 |
| 5,690,244 | A | * | 11/1997 | Darr | 220/673 |
| 5,729,794 | A | | 3/1998 | Schwallie et al. | 399/106 |
| 6,095,360 | A | * | 8/2000 | Shmagin et al. | 220/673 |
| 6,161,713 | A | * | 12/2000 | Krich | 215/384 |

* cited by examiner

*Primary Examiner*—Joseph M. Moy

(57) ABSTRACT

A container having opposing ends joined by a closing member, which closing member carries (a) a plurality of spread-apart ribs that radially encompass the periphery of the closing member, and (2) a plurality of radial sub-portions between adjacent ribs which sub-portions encompass the periphery of the closing member and a plurality of facets carried by the sub-portions.

10 Claims, 4 Drawing Sheets

CONTAINER

FIELD OF THE INVENTION

This invention relates to a container, preferably for a particulate product, which container is physically robust, and at the same time, both environmentally and ergonomically friendly. The container of this invention is particularly useful as a non-reservoir toner bottle for copying/printing machines. However, the container of this invention is not limited, nor intended to be limited to, containers for particulate product or toner bottles because it has numerous applications which will be obvious to one skilled in the art once apprised of its environmental and ergonomic advantages. For sake of clarity and brevity, this invention will be discussed in detail hereinafter primarily in relation to a container that carries solid particular toner product that is ultimately to be dispensed into the toner reservoir of a copying/printing machine.

BACKGROUND OF THE INVENTION

Heretofore, rectangular toner bottles have carried a plurality of spaced-apart vertical ribs to assist an operator when inserting the bottle into a copier/printer. See, for example, U.S. Pat. No. 4,982,771 issued Jan. 8, 1991, and U.S. Pat. No. 4,062,385 issued Dec. 13, 1977.

A curvilinear toner bottle is shown in U.S. Pat. No. 5,729,794 issued Mar. 17, 1998, which appears to disclose partial spaced-apart ribs transverse to the longitudinal axis of the bottle, which ribs extends over substantially less than half of the full periphery of the bottle. The use of partial ribs can result in weak spots in the container unless more material is used in making the container.

SUMMARY OF THE INVENTION

By this invention, a physically robust container is provided by use of a combination of full periphery ribbing and facets carried on such ribbing as disclosed in detail hereinafter.

Because of such combination of full ribbing and facets thereon, not only does the container of this invention achieve improved physical strength, but does so while using less material to make the container, which is environmentally desirable. Further the container of this invention is readily adapted to be made from recyclable material. The container is also readily formed by using blow molding techniques, which have low process waste. Therefore, this invention is environmentally friendly from a number of points of view.

The ribbing/facet combination of this invention, besides increasing container strength by using less container-forming material, provides ergonomically friendly gripping surfaces for an operator, no matter which way an operator initially grasps or ultimately manipulates the container.

DESCRIPTION OF THE PREFERRED EMBODIMENTS

Due to the particular combination of full ribbing and facets thereon, a container of this invention can be formed from a wide variety of materials. Polymeric materials are presently preferred, although not required, because of their amenability to container injection/blow molding processes. For example, the container can readily be made using a conventional process well known in the art, which involved first injection molding of high tolerance parts such as threaded portions, followed by heating the body of the container (other than the high tolerance parts), and then high pressure air molding of the body to yield the final container form.

Accordingly, conventional polymers such as high-density polyethylene, polypropylene, polyvinylchloride, polyallomers, or copolymers thereof can be employed. For toner bottles, in addition to the foregoing polymers, essentially any polymeric material that will yield a high-strength, preferably transparent or translucent container in order to see the toner level therein, is useful. A number of such polymers are well known in the art. One such polymer that is presently preferred is polyethyleneterephthalate, which not only yields a high clarity product, but is readily recyclable and accepts twenty-five percent or greater post-consumer recycle.

By combining polyethyleneterephthalate, the foregoing injection/blow molding process, and the ribbing/facet combination of this invention, a container is formed that is of superior strength for filling, shipping, handling and operator use. Such container also has high clarity, uses minimum container-forming polymer, has reduced manufacturing waste, is recyclable to a maximum extent, and has improved tolerance control such as opening flatness for better closure sealing at the dispensing aperture end. These are a considerable combination of improvements over and not obvious from the prior art.

Figure 1:
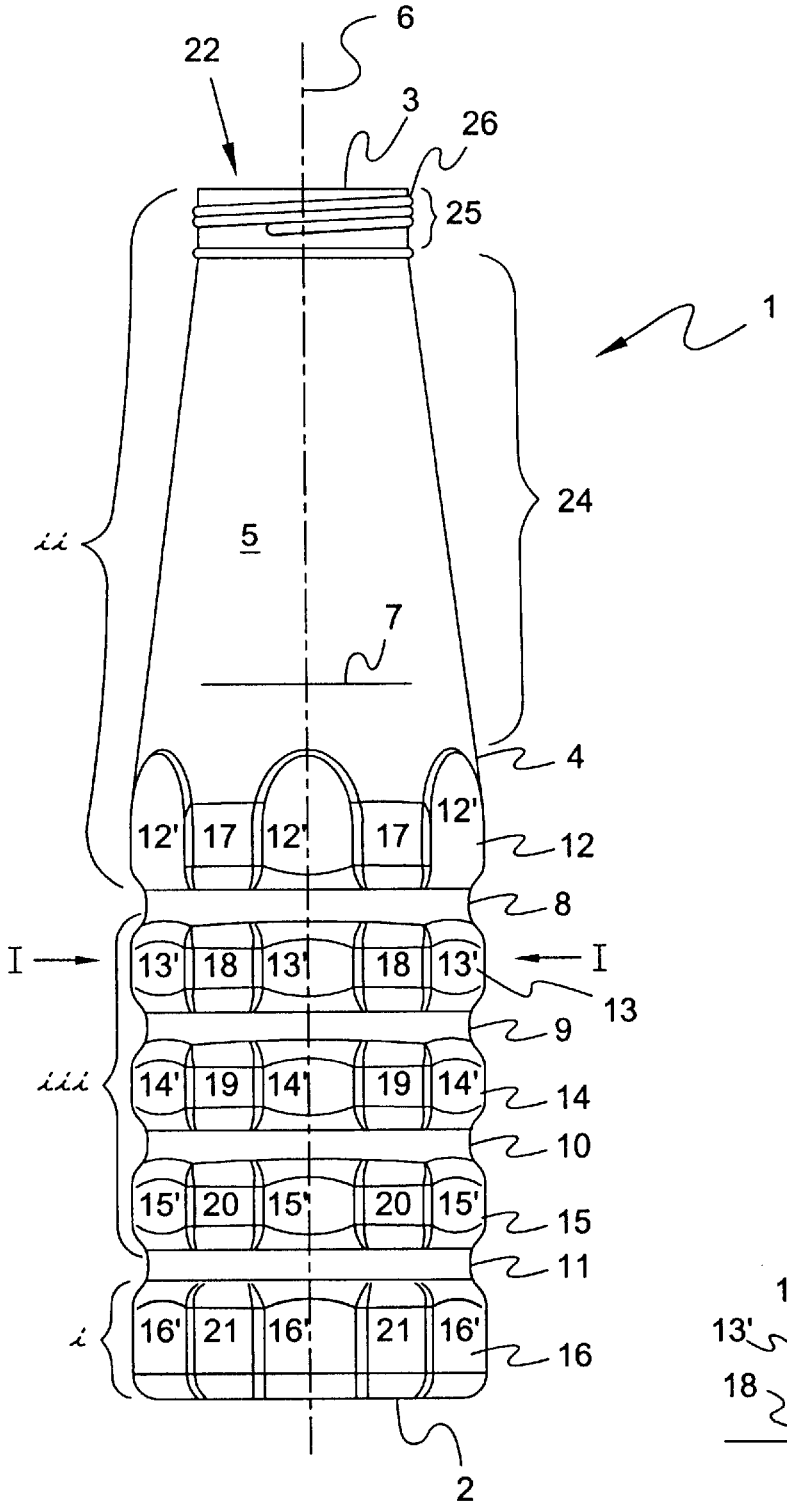
FIG. 1 is a side view of a container of this invention.
Figure 3:
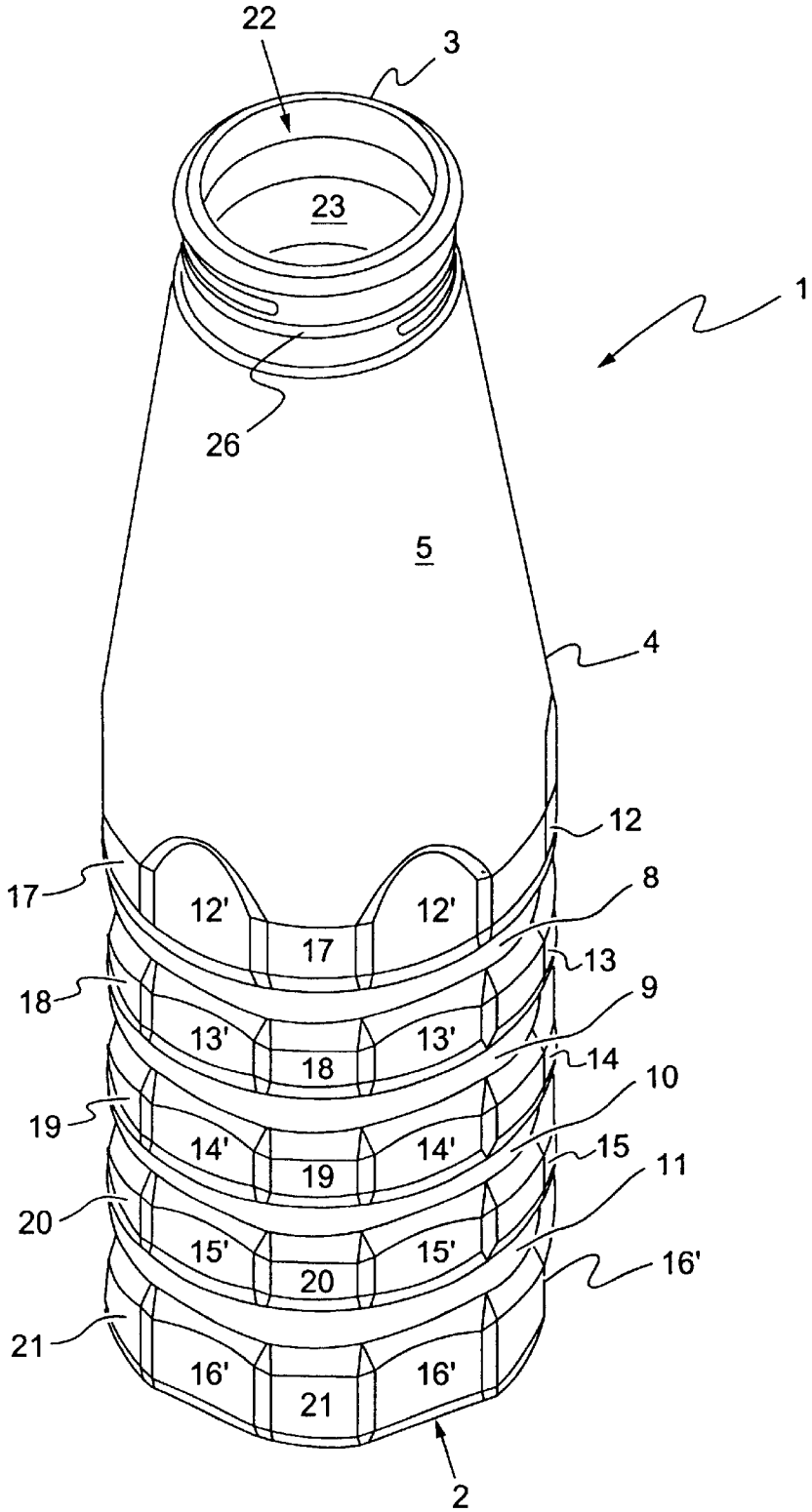
FIG. 3 is an isometric view of the dispensing end of the container of FIG. 1.

More specifically, FIG. 1 shows container 1 of this invention which has a first end 2 which carries no dispensing aperture and a spaced-apart second end 3 which has a dispensing aperture better shown in FIG. 3. Spaced-apart first and second ends 2 and 3 are joined by an elongate closing (enclosing) member 4 which encloses a inner volume between ends 2 and 3 and within the inner surface of enclosing member 4 as shown in FIG. 3. FIG. 1 shows outer surface 5 of enclosing member 4 and a longitudinal axis 6 and transverse axis 7 of container 1 and enclosing member 4, which are identical.

Enclosing member 4 carries a plurality of spaced-part ribs 8, 9, 10, and 11, which extend radially around the periphery of closing member 4. These ribs define radial sub-portions of closing member 4 identified as elements 12, 13, 14, 15, and 16. These radial sub-portions also extend radially around the periphery of closing member 4. Ribs 8–11, in effect, divide enclosing member 4 in container 1 into three sections identified in FIG. 1 as (i), (ii), and (iii). Section (i) is between rib 11, which is the rib closest to first end 2 of the container and first end 2. Section (ii) extends between rib 8 and rib 11 and contains a plurality of ribs, such as 9 and 10, which define a plurality of sub-portions 13–15 within section (iii). Thus, the sub-portions of the container are defined by adjacent ribs. For example, sub-portion 13 is defined by adjacent ribs 8 and 9.

Each of sub-portions 12–16 carries a plurality of individual facets carried on each such sub-portion, said facets identified by prime numbers that correspond to the sub-portion on which they are carried. For example, sub-portion 12 carries three facets which are separated by segments of outer surface 5, identified as items 17 in FIG. 1. Similarly, sub-portion 13 carries non-faceted portions 18 of outer surface 5 between adjacent facets 13'. The same is true for portions 19, between adjacent facets 14', non-faceted portions 20, between adjacent facets 15', and non-faceted portions 21, between adjacent facets 16'.

Although container 1 of FIG. 1 is shown to be curvilinear, this invention is not necessarily so limited, non-curvilinear profiles being equally amenable to the advantages of this invention. Also, ribs 8–11 are shown in FIG. 1 to be essentially transverse to longitudinal axis 6, but this is not necessarily required to obtain the advantages of this invention, ribbing that is not essentially at right angles to long axis 6 being equally amendable to obtaining the advantages of this invention.

Further, it can be seen from FIG. 1, that ribs 8–11 extend inwardly from outer surface 5 of enclosing member 4 so that the outer surface of sub-portions 12–16, e.g., segments 17–21, is the same as the outer surface 5 in closing member 4. Also, the outer surface of the segments 17–21 between adjacent facets on each rib is the same as the outer surface 5 of closing member 4.

The individual facets 12'–16' are spaced apart from one another by unfaceted portions 17–21 of each sub-portion 12–16. The unfaceted sub-portions 17–21 can be quite small or can be quite substantial, as is shown in FIG. 1. Thus, FIG. 1 shows facets substantially spaced apart from one another around the periphery of container 1, but this is not a requirement to achieve the advantages of this invention.

Adjacent facets in one or more sub-portions can closely approach one another so as to be almost contiguous, but not actually contiguous, there being a small unfaceted segment, however small, between adjacent facets. In a given container, the spaced-apart facets need not all be substantially spaced apart or all essentially contiguous. Combinations of substantial spacing and essentially contiguous spacing of facets on the same container are useful in certain container applications and are within the scope of this invention.

As can be seen in FIG. 1, section (ii) is substantially longer than section (i). Section (ii) can have one or more sub-portions 12, but in the case of FIG. 1, shows only one sub-portion 12 immediately adjacent rib 8, thereby leaving an extended space 24 which has no facets and is essentially smooth. Further, it can be seen that the transverse cross-section of second end 3 is substantially smaller than the cross-section of container 1 in the vicinity of section (iii) so that the smooth portion 24 of section (ii) tapers inwardly, i.e., necks down from the larger diameter container in sections (i) and (iii) to the smaller diameter dispensing aperture 22 of second end 3.

FIG. 1 also shows that second end 3 has an essentially straight shoulder 25 which carries threads 26 thereon which are adapted to received a threaded closing means (not shown) for sealingly closing the interior of container 1 once a product is placed in that interior volume. When the product is copying/printing machine toner and the materials from which the container is composed is either transparent or translucent, the level of the. toner inside the container can readily be ascertained by an operator, even though the container is closed and sealed.

Although in FIG. 1, section (ii) is shown to be considerably longer than section (iii), this is not a requirement for this invention. The relative lengths of any of sections (i)–(iii) can vary depending upon the desires of the manufacturer. When the product carried within container 1 is desired to be deployed, the sealing means (not shown) one end 3 is removed by disengagement from threads 26 on shoulder 25, and all or any part of the contents of container 1 dispensed into the desired receptacle, e.g., the toner reservoir of a copying/printing machine.

Thus, it can be seen that the use of a plurality of ribs which strengthen container 1, much as an arch strengthens an edifice, in combination with a plurality of facets that further add to the strength of the container and provide ergonomic advantages for an operator yield a superior container product.

Figure 2:
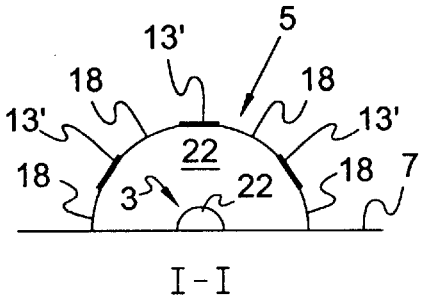
FIG. 2 is a cross-sectional view of one-half of the container of FIG. 1 along its transverse axis.

FIG. 2 shows the top half of a transverse cross-section along section I—I of FIG. 1, looking toward second end 3 and at dispensing aperture 22 thereof. FIG. 2 shows inner surface 23 of closing member 4, which inner surface 23 encloses the interior volume of container 1, which volume receives and holds the product desired.

Facets 13' are shown in exaggerated form in FIG. 2 for the sake of clarity. In reality, as can be better seen from the other figures hereof, the segments 18 of outer surface 5 are at about the same level as facets 13'. This is also true of the other sub-portions 12 and 14 through 16.

FIG. 3 shows the container of FIG. 1, but better shows second end 3, which contains smaller transverse cross-sectional aperture 22. Through aperture 22 can be seen inner surface 23 of closing member 4.

Figure 4:
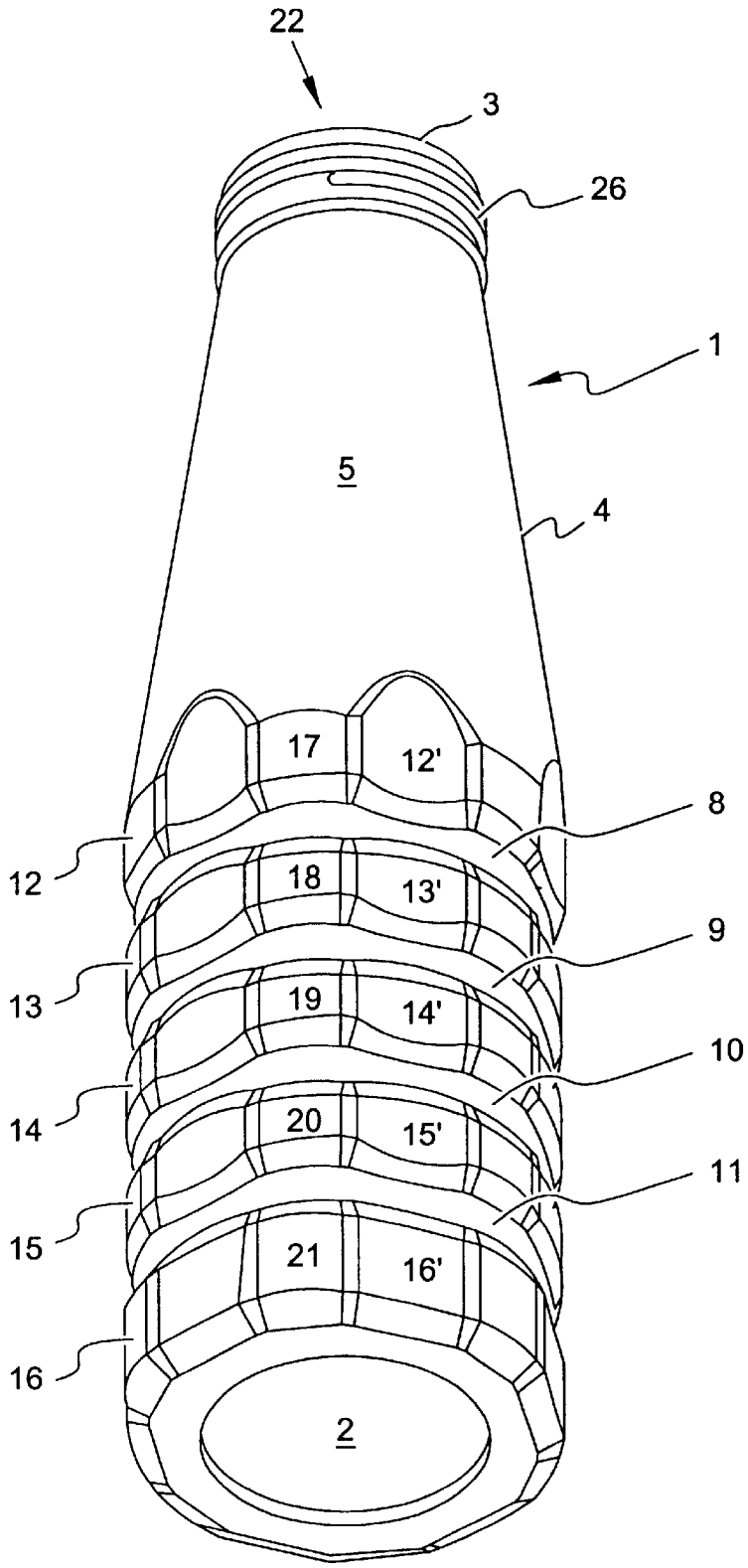
FIG. 4 is an isometric view of the opposing end of the container of FIG. 1.

FIG. 4 shows better the non-dispensing aperture end 2 of container 1.

Figure 5:
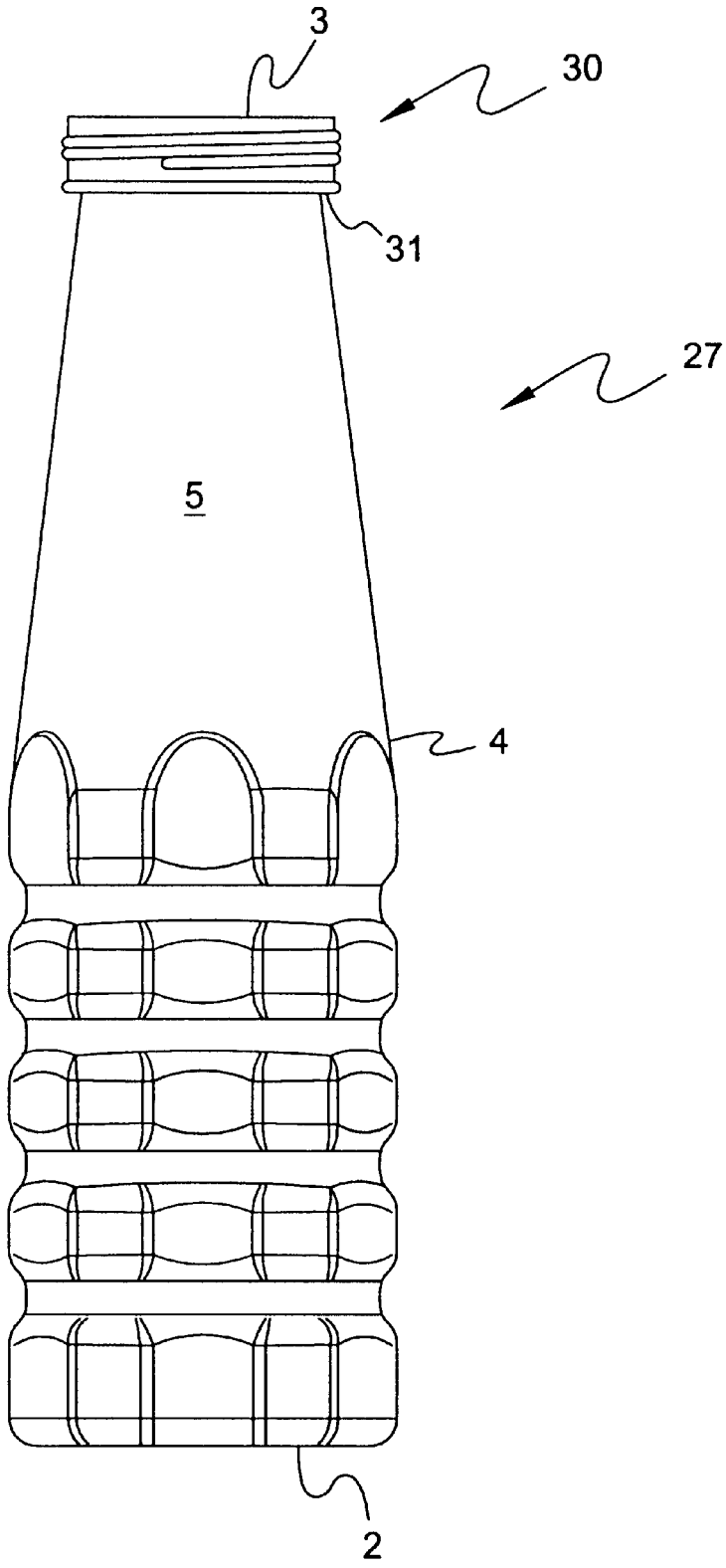
FIG. 5 is a side view of a different embodiment of the container of this invention.

Once apprised of the advantages of this invention, one skilled in the art can make many changes within the scope and spirit of this invention. For example, FIG. 5 shows a container 27 which is essentially the same as the container of FIG. 1, except that container 27 carries an enlarged neck finish 30. Neck 30 extends a finite portion 31 away from outer surface 5 of the closing member 4, thereby providing for an alternate closure member for use with a different particulate product and/or a different application or use for container 27 from that of container 1.

As an example, the container of FIG. 1, when adapted to carry copying/printing machine toner therein, can have a height, i.e., the sum of sections (i)–(iii) of about 14 inches plus a ¾ inch shoulder 25. The diameter of the body of closing member 4 as represented by first end 2 is about 4½ inches. Space 24 extends along the longitudinal axis 6 of about 8 inches and necks down to a dispensing aperture 22 diameter of about 2½ inches. The main body of container 1, which carries the ribbing and facet combination of this invention, employs the four spaced-part ribs and three sections shown in FIG. 1 with each sub-portion carrying six approximately 1⅜ inch long facets around the 14½ inch periphery of the container. The facets are spaced apart from one another about 1 inch. This construction provides an ideal container for carrying toner.

Having thus described the invention by reference to certain of its preferred embodiments, it is pointed out that the embodiments described herein are illustrative only and not limiting in nature, and that many variations and modifications are possible within the scope of this invention.

Having thus described the invention, we claim:

1. A container for holding a particulate product to be dispensed from the interior of said container, said container having first and second spaced-apart ends connected to one another by an elongate, hollow closing member, said closing member having inner and outer surfaces and longitudinal and transverse axes, said longitudinal axis extending between said first and second ends, said closing member defining along said longitudinal axis an enclosed interior volume within said inner surface and between said first and second ends, said first end having no dispensing aperture, said second end having an aperture through which said product is dispensed, the improvement comprising: said closing member having in combination;

(a) a plurality of spaced-apart ribs that extend radially around the periphery of said closing member, said spaced-apart ribs defining there between radial sub-portions of said closing member which sub-portions extend around the periphery of said closing member, said sub-portions including sections,
   (i) a sub-portion between said first end and the rib closest to said first end,
   (ii) a sub-portion between said second end and the rib closest to said second end, and
   (iii) at least one sub-portion between said rib closest to said first end and said rib closest to said second end; and, (b) a plurality of individual facets carried on each said sub-portion, said facets being substantially flat and disposed radially around the periphery of said closing member.

2. The container of claim 1 wherein said closing member is curvilinear and said ribs extend essentially transverse to said longitudinal axis.

3. The container of claim 1 wherein said ribs extend inwardly from said outer surface of said closing member so that the outer surface of said sub-portions is the same as the outer surface of said closing member, and the outer surface of said sub-portions between facets on each rib is the same as the outer surface of said closing member.

4. The container of claim 1 wherein said plurality of facets on each sub-portion are at least one of (a) spaced substantially apart from one another so that a substantial section of sub-portion is present between adjacent facets, (b) closely approach one another so that a very small section of sub-portion is present between adjacent facets, and (c) a combination of (a) and (b) herein.

5. The container of claim 1 wherein said section (ii) of said closing member between said second and said rib closest to the said second end is substantially longer along said longitudinal axis than either of section (i) or (iii).

6. The container of claim 5 wherein said sub-portion (ii) carries facets adjacent to said rib that is closest to said second end and has a space between said facets and said second end, said space having no facets.

7. The container of claim 6 wherein said space on said section (ii) which has no facets and is adjacent to said second end is essentially smooth and tapers inwardly as it approaches said second end.

8. The container of claim 2 wherein said ribs extend from said outer surface inwardly toward said interior of said container, said facets are spaced substantially apart from one another around the periphery of said closing member, said section (iii) has a plurality of ribs and sub-portions between said ribs that are closest to said first and second ends, said section (ii) of said closing member is substantially longer along said longitudinal axis than either of section (i) or (iii) and has a smooth outer surface between said facets of section (ii) and said second end, said second end has a smaller transverse cross section than said closing member, and said smooth outer surface necks down as it approaches said second end.

9. The container of claim 8 wherein said container is composed essentially of polyethyleneterephthalate.

10. The container of claim 9 wherein said product is particulate copying/printing machine toner and said second end is adapted to receive and hold a threaded closing means.

* * * * *